US010927611B2

(12) United States Patent
Roger et al.

(10) Patent No.: US 10,927,611 B2
(45) Date of Patent: Feb. 23, 2021

(54) METHOD FOR MANUFACTURING A TURNED-DOWN CENTRALIZER SUB ASSEMBLY

(71) Applicant: INNOVEX DOWNHOLE SOLUTIONS, INC., Houston, TX (US)

(72) Inventors: Greg P. Roger, Houma, LA (US); Jeff Musselwhite, Mineral Wells, TX (US); Brent James Lirette, Cypress, TX (US); Iain Levie, Spring, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 33 days.

(21) Appl. No.: 16/240,455

(22) Filed: Jan. 4, 2019

(65) Prior Publication Data

US 2019/0136643 A1 May 9, 2019

Related U.S. Application Data

(62) Division of application No. 14/978,466, filed on Dec. 22, 2015, now Pat. No. 10,208,544.

(60) Provisional application No. 62/098,399, filed on Dec. 31, 2014.

(51) Int. Cl.

| | |
|---|---|
| ***B21D 39/04*** | (2006.01) |
| ***B21D 41/04*** | (2006.01) |
| ***E21B 17/10*** | (2006.01) |

(52) U.S. Cl.

CPC ..... *E21B 17/1028* (2013.01); *B21D 39/04* (2013.01); *B21D 41/04* (2013.01); *Y10T 29/49865* (2015.01); *Y10T 29/49913* (2015.01)

(58) Field of Classification Search

CPC .. E21B 17/10; E21B 17/1014; E21B 17/1021; E21B 17/1028; E21B 17/1078; E21B 17/1085; B21D 39/04; B21D 41/04; Y10T 29/49865; Y10T 29/49913

See application file for complete search history.

(56) References Cited

U.S. PATENT DOCUMENTS 4,631,973 A * 12/1986 Eley ..... B23P 11/025 29/447
5,238,062 A 8/1993 Reinholdt
5,575,333 A 11/1996 Lirette et al.

(Continued)

FOREIGN PATENT DOCUMENTS

WO 00/66874 A1 11/2000

OTHER PUBLICATIONS

Extended European Search Report dated Aug. 24, 2018, EP Application No. 15876047, filed Jun. 29, 2017, pp. 1-7.

(Continued)

*Primary Examiner* — Jermie E Cozart

(74) *Attorney, Agent, or Firm* — MH2 Technology Law Group LLP

(57) ABSTRACT

A method for manufacturing a centralizer assembly includes reducing a diameter of a mandrel such that a turned-down region is formed in the mandrel, positioning a first stop segment in the turned-down region, and positioning a centralizer at least partially in the turned-down region, wherein the first stop segment is positioned intermediate of axial extents of the centralizer, such that the first stop segment at least partially limits a range of motion of the centralizer relative to the mandrel.

16 Claims, 7 Drawing Sheets

(56) References Cited

U.S. PATENT DOCUMENTS

| | | | | |
|---|---|---|---|---|
| 6,209,638 | B1 * | 4/2001 | Mikolajczyk | E21B 17/1028 166/241.1 |
| 6,484,803 | B1 * | 11/2002 | Gremillion | E21B 17/1028 166/241.1 |
| 6,513,223 | B1 * | 2/2003 | Angman | E21B 17/1078 166/379 |
| 7,140,432 | B2 * | 11/2006 | Gremillion | E21B 17/1028 166/241.6 |
| 7,182,131 | B2 | 2/2007 | Gremillion | |
| 2002/0139537 | A1 | 10/2002 | Young et al. | |
| 2003/0070803 | A1 | 4/2003 | Gremillion | |
| 2003/0150611 | A1 | 8/2003 | Buytaert | |
| 2005/0241822 | A1 | 11/2005 | Gremillion | |
| 2006/0102354 | A1 | 5/2006 | Gammage et al. | |
| 2011/0030973 | A1 | 2/2011 | Jenner | |
| 2012/0145410 | A1 | 6/2012 | Levie | |
| 2013/0319689 | A1 | 12/2013 | Levie et al. | |
| 2014/0367085 | A1 | 12/2014 | Levie et al. | |

OTHER PUBLICATIONS

Jin Ho Kim (Authorized Officer), International Search Report and Written Opinion dated Mar. 29, 2016, PCT Application No. PCT/US2015/067351, filed Dec. 22, 2015, pp. 1-17.

* cited by examiner

METHOD FOR MANUFACTURING A TURNED-DOWN CENTRALIZER SUB ASSEMBLY

CROSS-REFERENCE TO RELATED APPLICATIONS

This application is a divisional of U.S. patent application Ser. No. 14/978,466, filed Dec. 22, 2015, which claims priority to U.S. Provisional Patent Application Ser. No. 62/098,399, which was filed on Dec. 31, 2014, both of which are incorporated herein by reference in their entirety.

BACKGROUND

Oilfield tubulars, such as pipes, drill strings, casing, tubing, etc., may be used to transport fluids or to produce water, oil, and/or gas from geologic formations through wellbores. In various stages of wellbore drilling and completion, such tubulars may be positioned within (i.e., "run-in") the wellbore. During run-in, the oilfield tubulars may be maintained in a generally concentric position within the wellbore, such that an annulus is formed between the oilfield tubular and the wellbore (and/or another, surrounding tubular positioned in the wellbore).

Tools known as "centralizers" are employed to maintain this concentricity of the tubular in the wellbore. A variety of centralizers are used, including rigid centralizers, semi-rigid centralizers, and flexible, bow-spring centralizers. Bow-spring centralizers, in particular, are generally formed from two end collars and flexible ribs that extend between the collars. The ribs are expanded outward, and may be resilient, such that the bow-springs centralizers are capable of centralizing the tubular in the wellbore across a range of wellbore sizes.

Restrictions may exist in the wellbore in which the oilfield tubular is run. These restrictions may be areas where the inner diameter of the wellbore is reduced, which, in turn, reduce the clearance between the oilfield tubular and the wellbore. Examples of restrictions include lining hangers, the inner diameter of another, previously-run casing, and the wellhead inner diameter. When restrictions are present, bow-spring centralizers may be employed, and may be configured to collapse radially toward the oilfield tubular, allowing the centralizer to pass through the restrictions, while continuing to provide an annular standoff.

However, bow-spring centralizers generally have an operating envelope for clearance. When the clearance is too small, the bow-spring centralizers may be damaged when passing through the restriction, which may reduce the ability of the centralizers to provide a standoff below the restriction. Furthermore, oilfield tubulars generally include an amount of tolerance for the outer diameter (e.g., 1%), which can make determining the precise clearance size challenging.

SUMMARY

Embodiments of the disclosure may provide a centralizer assembly. The centralizer assembly includes a mandrel including a first raised region having a first diameter, and a turned-down region having a second diameter, the second diameter being smaller than the first diameter. The centralizer assembly also includes a first stop segment extending at least partially around the mandrel in the turned-down region, and a centralizer disposed at least partially in the turned-down region. The first stop segment is received between axial extents of the centralizer, to limit a range of motion of the centralizer relative to the mandrel.

Embodiments of the disclosure may also provide a method for manufacturing a centralizer assembly. The method includes reducing a diameter of a mandrel such that a turned-down region is formed in the mandrel, and positioning a first stop segment in the turned-down region. The method also includes positioning a centralizer at least partially in the turned-down region. The first stop segment is positioned intermediate of axial extents of the centralizer, such that the first stop segment at least partially limits a range of motion of the centralizer relative to the mandrel.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
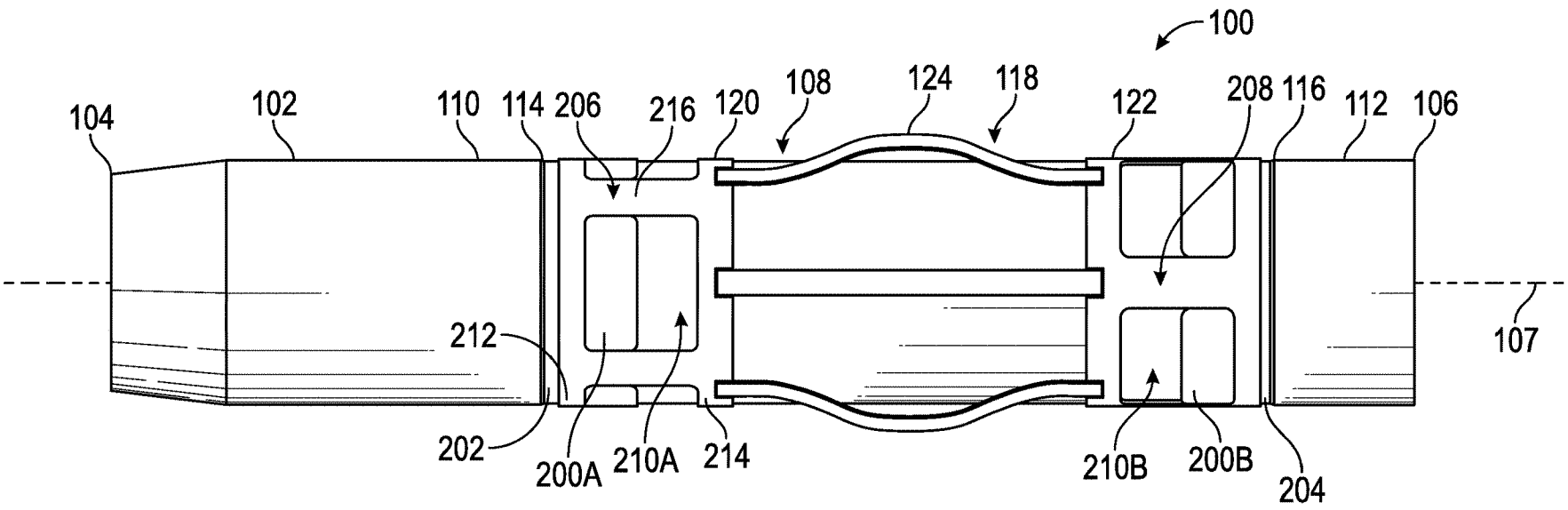
FIG. 1 illustrates a side perspective view of a centralizer assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side perspective view of a centralizer assembly 100, according to an embodiment. The centralizer assembly 100 may be employed, for example, to maintain an annular clearance between a casing string (or any other type of oilfield tubular) and a surrounding tubular (e.g., another casing or liner, or the wellbore wall in open-hole situations). The centralizer assembly 100 may include a mandrel 102, which may be referred to as "sub" or base pipe and may be specially formed or provided by a stock tubular, such as casing.

In some embodiments, the mandrel 102 may be formed from the same casing (or tubular) as a remainder of a string to which the centralizer assembly 100 may be attached. Further, the mandrel 102 may have a length comparable (e.g., the same, within tolerance, as) the adjacent casing. In a specific embodiment, the length of the mandrel 102 (and the other casing) may be about 30 feet (about 9 meters). Moreover, the mandrel 102 may be made from the same or a similar material as the remaining casing. In other embodiments, the mandrel 102 may be formed from a separate type, material, etc. of pipe, tubing, or the like, and may be longer or shorter than the adjacent casing joints.

Further, the mandrel 102 may include a first end 104, a second end 106, and a turned-down region 108 disposed between the first and second ends 104, 106, and spaced axially apart (e.g., along a longitudinal axis 107 of the centralizer assembly 100) from the ends 104, 106. The ends 104, 106 may be configured to be attached to axially-adjacent tubulars. Accordingly, in an embodiment, the first end 104 includes a threaded, pin-end connection, and the second end 106 may include a threaded, box-end connection (not visible in FIG. 1).

The turned-down region 108 may define an area of the mandrel 102 with a reduced diameter. Although "turned-down" is sometimes used in the context of lathing operations, the reduced diameter of the turned-down region 108 may be provided by any suitable method, using any suitable cutting or forming device. Further, the turned-down region 108 may be spaced apart from the ends 104, 106, such that the mandrel 102 may define two raised regions 110, 112. Shoulders 114, 116 may be defined where the raised regions 110, 112 meet or "transition" to the turned-down region 108. The two raised regions 110, 112 may have the same or different outer diameters, which may both be larger than the outer diameter of the turned-down region 108 and/or may be larger than the oilfield tubulars to which the mandrel 102 is connected. In some embodiments, however, one or more of the raised regions 110, 112 may be omitted.

More particularly, in an embodiment, either or both of the raised regions 110, 112 may define a first outer diameter for the mandrel 102. The turned-down region 108 may define a second outer diameter of the mandrel 102. In some embodiments, e.g., to meet regulatory requirements for maintaining burst and/or collapse (and/or other) ratings, the second diameter may be sized from about 0.5%, about 0.75%, or about 0.90% to about 2%, about 2.5%, and about 3% smaller than the first diameter. In a specific example, the second diameter may be about 1% smaller than the first diameter (e.g., first diameter×0.99=second diameter).

The centralizer assembly 100 may also include a centralizer 118, which may be disposed at least partially in the turned-down region 108. The centralizer 118 may include at least one end collar. In the illustrated embodiment, the centralizer 118 includes two, axially-offset end collars 120, 122. The surfaces of the end collars 120, 122 that face away from one another (i.e., the outboard surfaces) may define the axial "extents" of the centralizer 118. In an embodiment, the end collars 120, 122 may be disposed on opposite ends of the turned-down region 108, e.g., generally adjacent to the shoulders 114, 116, respectively.

The centralizer 118 may also include a plurality of ribs 124 which may extend axially between and be connected with (e.g., integrally or via welding, fasteners, tabs, etc.) the end collars 120, 122. In some embodiments, the ribs 124 may be flexible, and may be curved radially outwards from the end collars 120, 122. Such curved, flexible ribs 124 may be referred to as "bow-springs." In other embodiments, however, the ribs 124 may take on other forms, in shape and/or in elastic properties. In some embodiments, a coating may be applied to the ribs 124, the end collars 120, 122, and/or the mandrel 102. The coating may be configured to reduce abrasion to the ribs 124, end collars 120, 122, the mandrel 102, the casing (or another surrounding tubular in which the centralizer 118 may be deployed), or a combination thereof. The coating may, for example, also serve to reduce friction, and thus torque and drag forces, in the wellbore.

The centralizer 118 may be formed in any suitable way, from any suitable material. In a specific embodiment, the centralizer 118 may be formed by rolling a flat plate, and then seam welding the flat plate to form a cylindrical blank. The cylindrical blank may then be cut, so as to define the ribs 124 and end collars 120, 122. One such fabrication process may be as described in U.S. Patent Publication No. 2014/0251595, which is incorporated by reference herein in its entirety.

The centralizer assembly 100 may also include a plurality of stop segments 200A, 200B. The stop segments 200A, 200B may be disposed generally proximal to the shoulders 114, 116, respectively, and may be spaced axially apart from the shoulders 114, 116 so as to define circumferentially-extending channels 202, 204 between the stop segments 200A, 200B and the shoulders 114, 116, respectively. Further, the stop segments 200A may be axially-aligned and separated circumferentially apart so as to define axial channels 206 therebetween. Similarly, the stop segments 200B may be axially-aligned and separated circumferentially apart so as to define axial channels 208 therebetween.

The stop segments 200A, 200B may be positioned between the axial extents of the centralizer 118. In other words, the centralizer 118 may be positioned on both axial sides (i.e., opposing first and second axial sides) of the stop segments 200A, 200B. For example, as shown, the stop segments 200A, 200B may be received at least partially through windows 210A, 210B formed in the end collars 120, 122, respectively.

The end collars 120, 122 may be similar in structure. Referring to the end collar 120 as an example, the end collar 120 may include two offset bands 212, 214, with bridges 216 extending between the bands 212, 214. Adjacent pairs of bridges 216, in addition to the bands 212, 214, may define the windows 210A. The bridges 216 may be configured to slide between, in an axial direction, and bear on, in a circumferential direction, the stop segments 200A. The stop segments 200A and the windows 210A may thus cooperate to permit, as well as limit, an axial and/or circumferential range of motion for the centralizer 118 with respect to the mandrel 102. In particular, the bands 212, 214 may be configured to engage the stop segments 200A so as to limit an axial range of motion of the centralizer 118 with respect to the mandrel 102.

In some embodiments, the windows 210A may be larger, axially and/or circumferentially (e.g., have a larger axial dimension and/or larger circumferential dimension), than the stop segments 200A received therein. This relative sizing may provide a range of rotational and/or axial movement for the centralizer 118; however, in other embodiments, the windows 210A may be sized to more snugly receive the stop segments 200A, thereby constraining or eliminating movement of the centralizer 118 with respect to the mandrel 102.

Moreover, the bands 212, 214 of the end collar 120 may be received into the circumferential channels 202. In some embodiments, engagement between the shoulders 114, 116 and the band 214 may limit an axial range of motion of the centralizer 118 with respect to the mandrel 102. For example, an axial range of motion needed to provide for axial expansion of the centralizer 118 during radial collapse of the ribs 124 may be determined, and the spacing of the channels 202, taking into consideration the thickness of the band 214, may be calculated. Further, in some situations, the thickness of the bands 214 may be adjusted.

Figure 2:
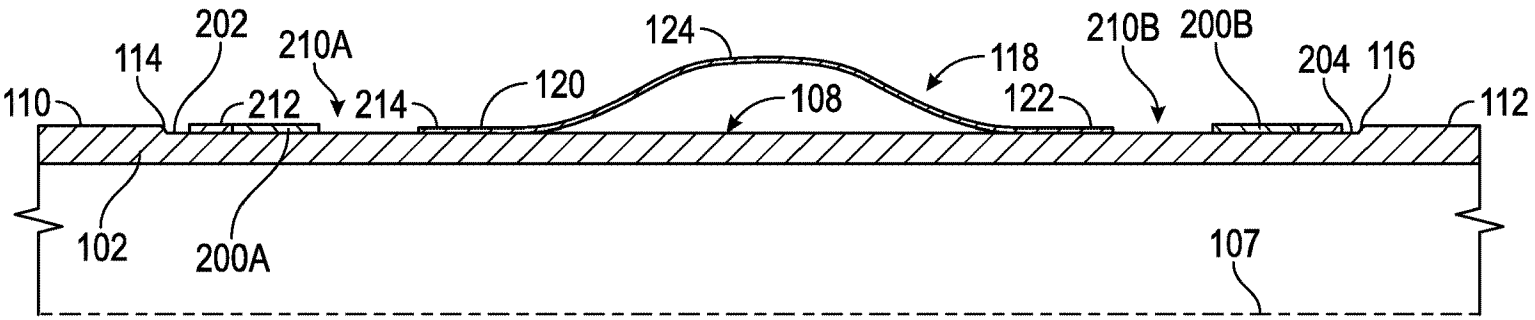
FIG. 2 illustrates a side, cross-sectional view of a portion of a centralizer assembly, according to an embodiment.

FIG. 2 illustrates an enlarged, partial cross sectional view of the centralizer assembly 100, according to an embodiment. As shown, the centralizer assembly 100 includes the mandrel 102 defining the raised regions 110, 112 and the turned-down region 108. The shoulders 114, 116, defined where the turned-down region 108 transitions to the raised regions 110, 112, respectively, may be inclined, as shown, so as to form an angle with respect to the longitudinal axis 107. For example, as proceeding away from the stop segments 200A, 200B and/or away from the turned-down region 108, the outer diameter of mandrel 102 at the shoulders 114, 116 may increase. The shoulders 114, 116 may be inclined so as to reduce stresses in the transition in diameters. In an embodiment, the shoulders 114, 116 may be disposed at an any angle between about 1° and about 90°, for example, at an angle in the range of from about 1°, about 5°, or about 10° to about 20°, about 25°, about 30°. In a specific example, the shoulders 114, 116 may be inclined at an angle of about 15°.

Further, the shoulders 114, 116 may extend at least as far radially as the end collars 120, 122 and/or the stop segments 200A, 200B. That is, the first diameter of the mandrel 102 at the raised regions 110, 112 may be at least as large as the second diameter of the mandrel 102 in the turned-down region 108 plus twice the thickness of the end collars 120, 122 (or the stop segments 200A, 200B). Accordingly, the raised regions 110, 112 may protect the edges and end faces of the bands 212, 214 and stop segments 200A, 200B from contact with foreign objects in the wellbore. Since the centralizer 118 may be formed from a relatively thin material (e.g., relative to the mandrel 102), the protection by the shoulders 114, 116 may assist in preventing damage to the centralizer 118.

The stop segments 200A, 200B may be formed from a material that is different from the material making up the mandrel 102, and may be coupled to the mandrel 102 in the turned down region 108 using any suitable process. For example, the stop segments 200A, 200B may be formed from one or more layers of a thermal spray, such as WEAR-SOX®, which is commercially available from Antelope Oil Tool & Mfg. Co., LLC. In an embodiment, the thermal spray forming the stop segments 200 may be as described in U.S. Pat. No. 7,487,840 or U.S. patent application Ser. No. 14/471,630, both of which are incorporated herein by reference in the entirety, to the extent not inconsistent with the present disclosure.

In another embodiment, the stop segments 200A, 200B may be formed from an epoxy injected into a composite shell, such as, for example, described in U.S. patent Ser. No. 14/374,442, which is incorporated herein by reference in its entirety, to the extent not inconsistent with the present disclosure. For example, in some embodiments, the stop segments 200A, 200B may be formed from an epoxy, a composite, or another molded material connected to the mandrel 102.

In still another embodiment, the stop segments 200A, 200B may be made from the same material as the mandrel 102 and, e.g., may be integrally-formed therewith. For example, the turned-down region 108 may be formed by cutting around the areas designated for the stop segments 200A, e.g., leaving the channels 202, 206 and forming the shoulder 114. The stop segments 200B and the channels 204, 208 may be similarly formed.

Figure 3A:
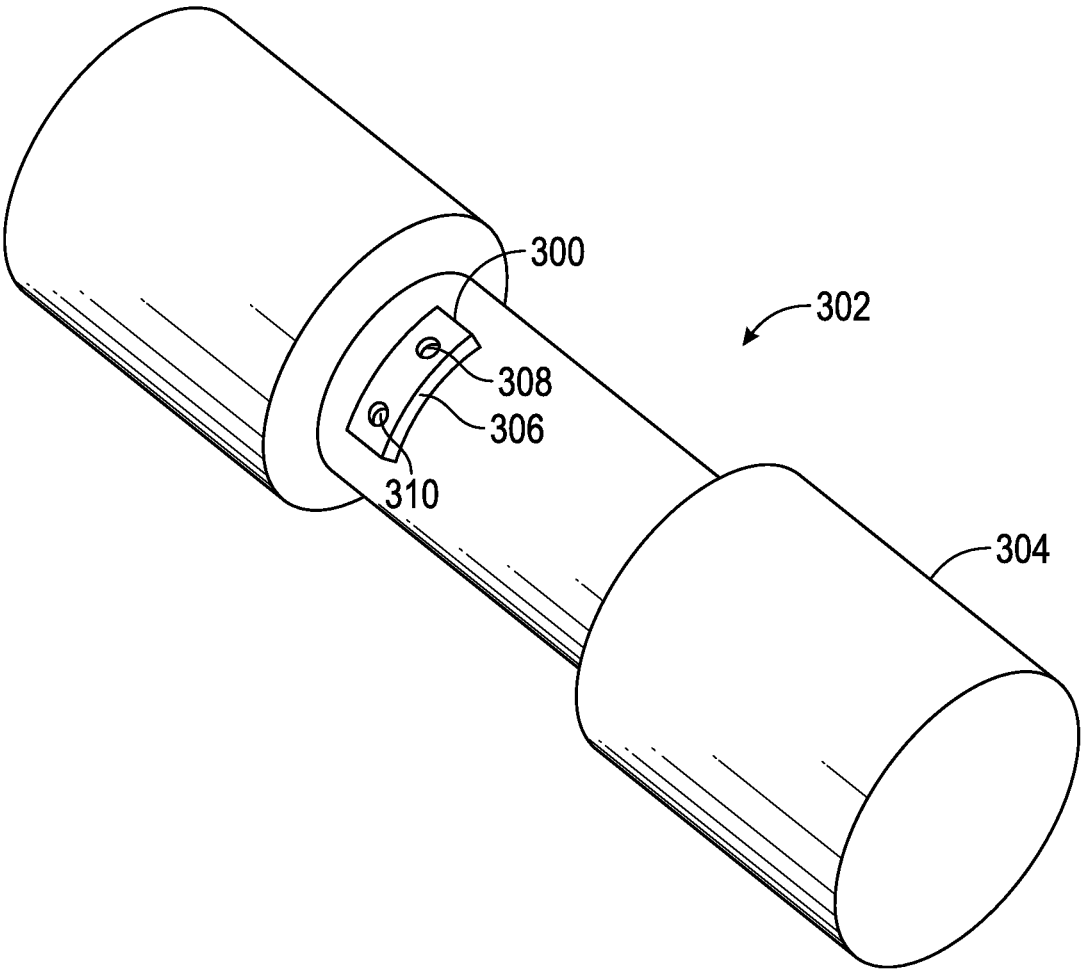
FIG. 3A illustrates a perspective view of a mandrel and a stop segment, according to an embodiment.
Figure 3B:
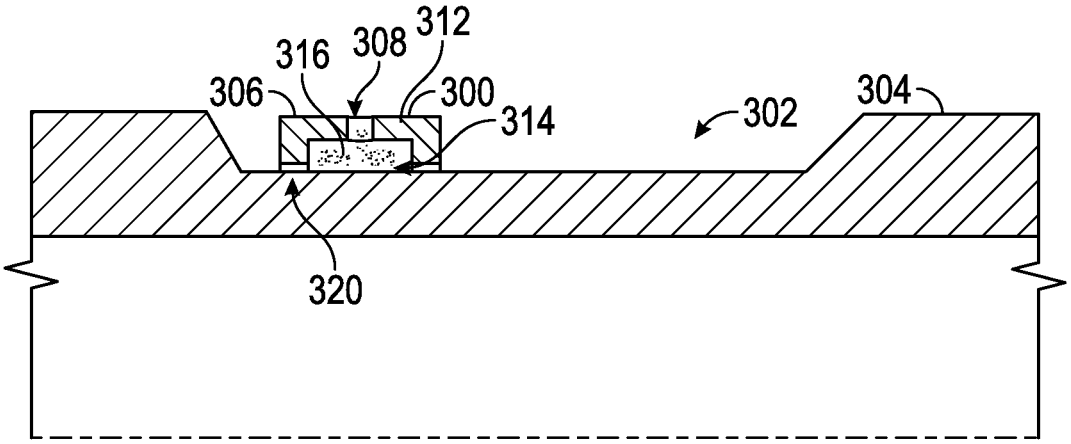
FIG. 3B illustrates a side, cross-sectional view of a mandrel and a stop segment, according to an embodiment.

FIGS. 3A and 3B illustrate a perspective view and a cross-sectional view, respectively, of an example of such an embodiment, in which a stop segment 300 is formed in a turned-down region 302 on a mandrel 304 from an epoxy injected into a shell 306. It will be appreciated that the dimensions of the features of this embodiment may be exaggerated in FIGS. 3A and 3B for purposes of illustration.

As shown, the shell 306 may be arcuate and may extend at least partially around the mandrel 102. The shell 306 may define one or more inlet ports 308 and one or more outlet ports 310. The inlet and outlet ports 308, 310 may extend through an outer wall 312 of the shell 306 and communicate with a cavity 314 defined within the shell 306. The shell 306 may also include one or more braces or struts extending across the internal cavity 314 so as to increase a rigidity of the shell 306. An inner surface of the shell 306 (e.g., defining the internal cavity 314) may include protrusions, scales, etc. so as to provide a keying surface for a bonding material 316. Further, the shell 306 may define a beveled region along at least a portion of the periphery thereof, and may also include one or more ridges on the periphery.

The shell 306 may be formed at least partially from a fiber mat infused with a resin matrix. Further, ceramic particulates, such as zirconium dioxide or silicon nitride, may be applied to the resin-infused fiber mat. A friction-modifying material, such as fluorocarbon particulates, may be applied to all or a part of the shell 306, so as to provide a low-friction surface on at least a portion of the outer diameter of the stop segment 300.

During assembly, the shell 306 may be temporarily held in position using a strap or another device. The bonding material 316 may then be injected through the inlet port(s) 308. Suction may be applied to the outlet port(s) 310, so as to evacuate air from the cavity 614 during or prior to injection of the bonding material 316. In other embodiments, the injection of the bonding material 316 itself may force air, or any other gases or fluids, out of the outlet ports 310, without requiring an externally-generated pressure differential (e.g., suction) to be applied to the outlet port(s) 310.

The bonding material 316 may flow into the cavity 314 and may, e.g., upon curing, connect the shell 306 with the mandrel 102. In some embodiments, the bonding material 316 may proceed through recesses 320 formed along the periphery of the shell 306. Optionally, one or more bonding materials may remain uncured, at least initially, within the shell 306, and may be expelled when the shell 306 is compressed, e.g., so as to increase a coupling strength with another structure received at least partially around the stop segment 200. In some embodiments, the shell 306 may remain on the mandrel 102 after the bonding material 316 has cured. In other embodiments, however, the shell 306 may be removed, leaving the bonding material 316 providing the stop segment 300.

Figure 4:
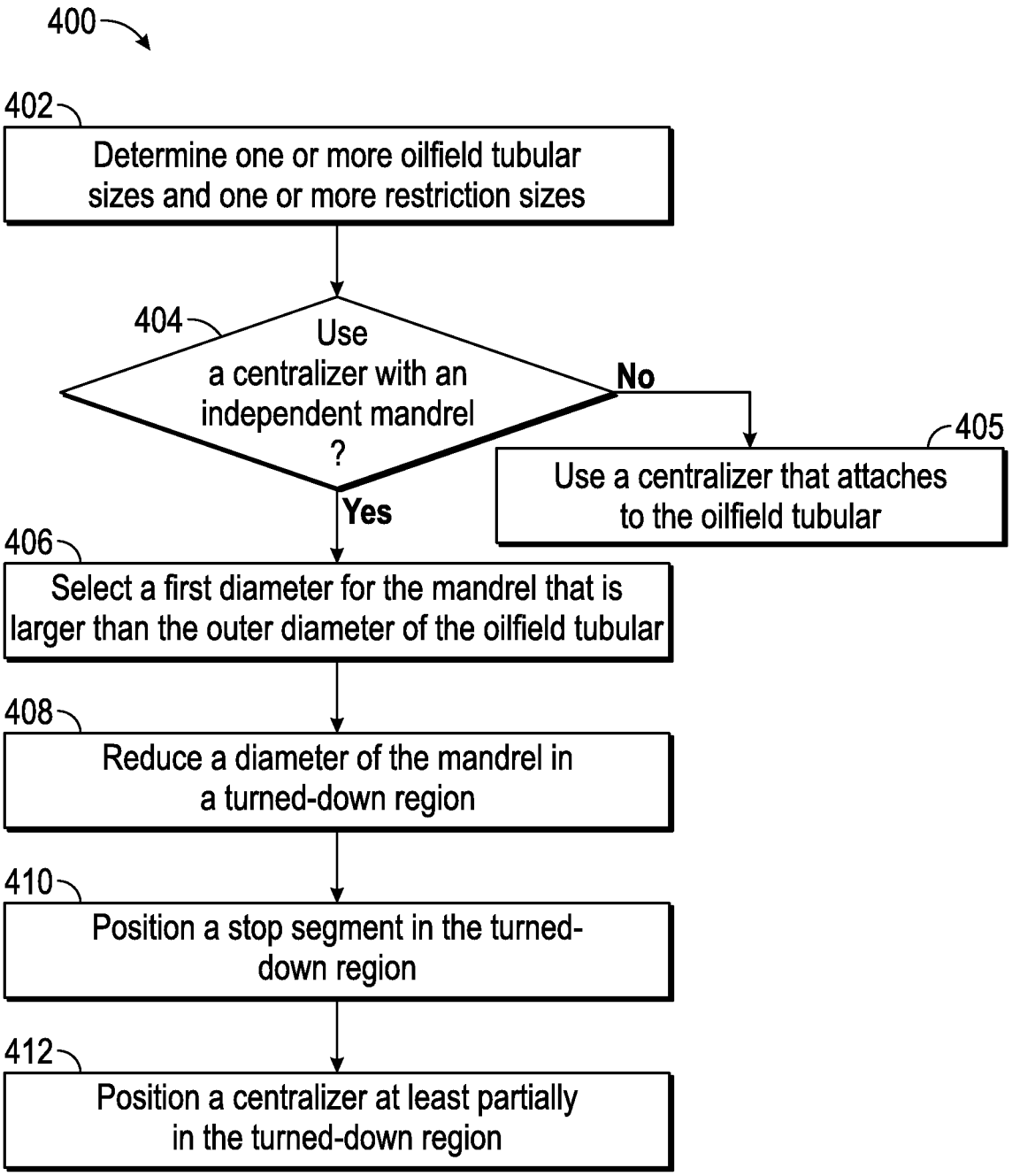
FIG. 4 illustrates a flowchart of a method for manufacturing a centralizer assembly, according to an embodiment.

FIG. 4 illustrates a flowchart of a method 400 for manufacturing a centralizer assembly 100, according to an embodiment. In some embodiments, the method 400 may result in an embodiment of the centralizer assembly 100 discussed above. However, other embodiments may result in other centralizer assemblies, and thus the structure of the centralizer assembly 100 is not to be considered limiting on the method 400, unless otherwise expressly stated herein.

The method 400 may begin by determining one or more oilfield tubular sizes and one or more restriction sizes in the wellbore, as at 402. The method 400 may then proceed to determining whether to use a centralizer including an independent mandrel, e.g., instead of a standard centralizer that is secured to the outer diameter of the casing (or other oilfield tubular), based on the oilfield tubular sizes and the one or more restriction sizes, as at 404.

As mentioned above, restrictions may represent areas of reduced clearance between a surrounding tubular (e.g., casing, liner, or wellbore wall) and the oilfield tubular. For example, centralizers may generally define an operating envelope for clearance. If the downhole conditions (e.g., clearance) are within the operating envelope, the method 400 may include using a centralizer that attaches to the oilfield tubular, as at 405. Otherwise, if the clearance is below the envelope for an over-the-casing centralizer, the method 400 may include determining, at 404, to use a centralizer assembly including an independent mandrel (e.g., a separate mandrel coupled with the oilfield tubular, such as the mandrel 102 (e.g., FIG. 1). As noted above, the mandrel 102 may be formed from a length or "joint" of casing that is the same or similar in dimension and material as casing joints that are, or will be, adjacent and/or connected to the mandrel 102 in a casing string. In other embodiments, the mandrel 102 may be specially formed and have any suitable dimension, made from different materials, etc., in comparison to the adjacent casing joints.

The method 400 may then include selecting a first diameter for a mandrel of the centralizer assembly, such that the first diameter is larger than the diameter of the oilfield tubular to which the mandrel is configured to be connected, for example about 1% larger, as at 406. This increase in diameter may allow the mandrel to include a turned-down region, without a reduction in burst and/or collapse pressure ratings.

The method 400 may also include reducing a diameter of the mandrel at a turned-down region, as at 408, e.g., such that the mandrel defines a second, smaller diameter, in the turned-down region. In an embodiment, this may be accomplished by machining the mandrel, e.g., on a lathe. In such a machining embodiment, a device may be employed to hold the tubular so that the outer diameter is machined to be concentric with the inner diameter, so as to maximize the minimum wall thickness and thereby maintain burst and collapse pressure strength and ratings. For example, an expandable internal mandrel acting as a chuck may be employed. Machining the mandrel may be accomplished by rotating the mandrel or by moving the cutting tool around the mandrel.

In another embodiment, the diameter of the mandrel at the turned-down region may be reduced via a swaging operation. In such an operation, the outer diameter of the centralizer may be reduced, e.g., using dies, until the inner diameter is larger than the casing drift by from about 0.010 inches (0.25 mm) to about 0.030 inches (0.76 mm), e.g., about 0.020 inches (0.51 mm). This may result in the outer diameter of the casing being less than the nominal outer diameter, which may provide clearance for the centralizer in a tight annulus. In some cases, a forming mandrel may be slid within the casing to the location where the outer diameter is to be reduced, which may serve to keep the inner diameter above the drift, i.e., providing an end-range for the reduction in the inner diameter. The forming mandrel may, for example, be collapsible to facilitate removal after the swaging operation. Further, an end of the mandrel of the centralizer assembly, e.g., the pin end thereof, may facilitate the swaging operation.

In other embodiments, a forming process, such as casting, may be employed to provide the reduced diameter, turned-down region, without departing from the scope of the term "reducing a diameter of the mandrel."

The turned-down region may be spaced axially apart from the ends of the mandrel, and may thus define a shoulder with a relatively raised region of the mandrel, e.g., where the diameter of the mandrel increases from the turned-down region to the raised regions. The shoulders may be formed at an incline, e.g., at an angle such that the diameter of the mandrel increases as proceeding away from the middle of the turned-down region.

The method 400 may then proceed to positioning a stop segment in the turned-down region, as at 410, e.g., after reducing the diameter of the mandrel. In an embodiment, this may be accomplished using a thermal spray deposition technique, as described above. In another embodiment, the stop segment may be constructed from a shell that has an epoxy bonding material injected into it, such that the stop segment is formed from the shell and the bonding material. In other embodiments, a strip of metal may be attached to the mandrel. In another embodiment, the stop segment may be integrally formed with the mandrel. In still other embodiments, any type of process for forming a raised stop segment in the turned-down region may be used.

Before, during, or after positioning the stop segment in the turned-down region, the method 400 may include positioning a centralizer in the turned-down region, as at 412. The centralizer may be formed by rolling a thin, flat plate, seam-welding the ends, and then cutting out end portions thereof to form the collars and ribs. In some embodiments, the centralizer may be formed in other ways or using additional techniques.

When both the centralizer and the stop segment are assembled in the turned-down region, the stop segment may be positioned between axial extents of the centralizer. For example, the centralizer end collars may be formed with windows defined between axially-offset bands connected together with bridges. The bands and bridges may together define windows. The windows may receive the stop segments therethrough. The windows and stop segments, as well as the shoulder of the mandrel, may thus define a range of motion, e.g., axially and/or circumferentially, for the centralizer with respect to the mandrel.

Figure 5:
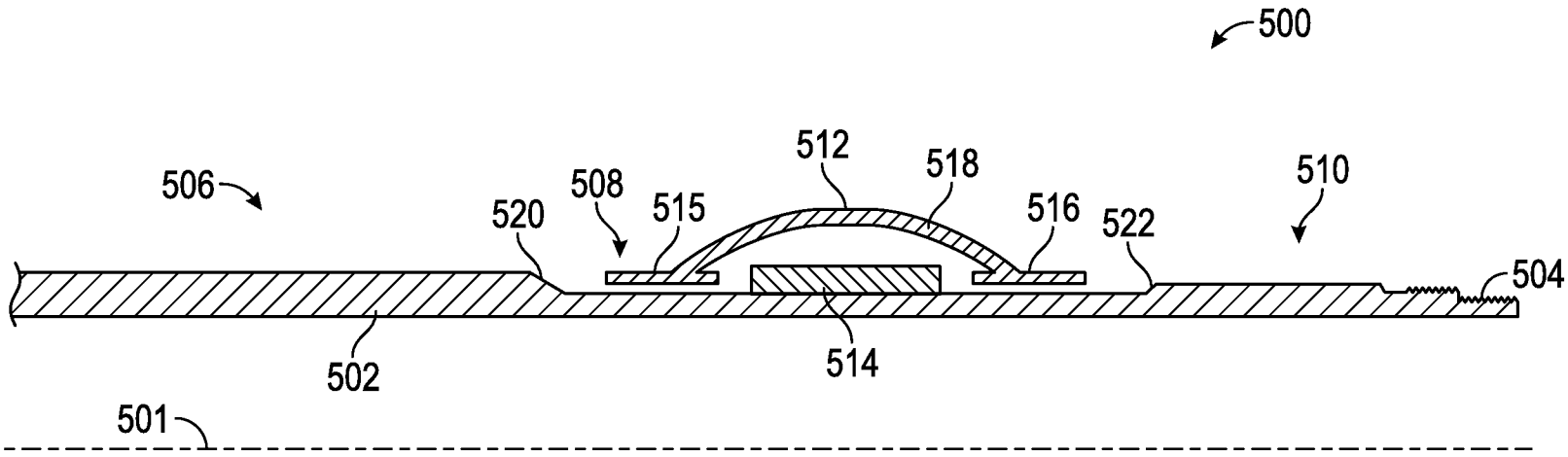
FIG. 5 illustrates a side, cross-sectional view of a portion of another centralizer assembly, according to an embodiment.

FIG. 5 illustrates a side, cross-sectional view of another centralizer assembly 500, according to an embodiment. The centralizer assembly 500 may include a mandrel 502 which may be hollow and may define a central axis 501. For example, the mandrel 502 may be a segment of standard casing (or other types of oilfield) tubular. In other embodiments, other types of tubulars may be employed. Further, the illustrated mandrel 502 may include a pin end 504, which may be sized to be received into and threaded or otherwise coupled with a box end of an axially-aligned, adjacent tubular.

The mandrel 502 may include a first raised region 506, a turned-down region 508, and at least one second raised region 510. The first raised region 506 may, for example, not require further machining or forming operations after the mandrel 502 is formed. The turned-down region 508 may be formed axially between the first and second raised regions 506, 510. The second raised region 510 may be disposed between the pin end 504 and the turned-down region 508. For example, the second raised region 510 may extend to the pin end 504. The length of the second raised region 510 may, for example, be selected so as to allow tongs or other tubular-handling equipment to grip the second raised region 510. Further, the mandrel 502 in the second raised region 510 may have a smaller diameter than the mandrel 502 in the first raised region 506, but a larger diameter than the mandrel 502 in the turned-down region 508.

The centralizer assembly 500 may also include a centralizer 512, having one or more end collars (two shown: 515, 516) and ribs, e.g., flexible bow springs 518, extending therebetween. A stop segment or "stop collar" 514 may be located, e.g., positionally fixed, axially, rotationally, or both, to the mandrel 502 in the turned-down region 508. The stop collar 514 may further be positioned axially between the end collars 515, 516 (and thus between the axial extents of the centralizer 512). In another embodiment, the stop collar 514 may be received through one of the end collars 515, 516 (e.g., similar to the stop segments 200A, FIG. 2). The stop collar 514 may extend partially or entirely around the mandrel 502, and may be integrally formed therewith or may be a separate piece which is attached thereto. Further, the stop collar 514 may have an outer diameter that is about equal to, or slightly less than, the outer diameter of the first raised region 506. The outer diameter of the stop collar 514 may also or instead be approximately equal to the outer diameter of the end collars 515, 516.

The stop collar 514 may be formed using any of the processes discussed above for the stop segments 200A, 200B and/or others (e.g., integral forming with the mandrel, bonding and molded plastic, thermal spray, etc.) or may be provided using a wound cable, e.g., as discussed in U.S. patent application Ser. No. 14/461,273 and/or a resistance fit, as described in either of U.S. Pat. No. 8,832,906 and U.S. patent application Ser. No. 14/461,297. Each of these disclosures is incorporated herein by reference.

The end collars 515, 516 may have an inner diameter that is larger, at least prior to assembly, than the outer diameter of the mandrel 502 at the second raised region 510. Accordingly, the end collars 515, 516 may be slid onto the mandrel 502 at the pin end 504 and axially along the mandrel 502. The inner diameter of one or both of the end collars 515, 516 may be smaller than the outer diameter of the first raised region 506, and thus, e.g., the end collar 515 may abut against the shoulder 520 formed between the first raised region 506 and the turned-down region 508, so as to provide an end range for axial movement along the mandrel 502. The stop collar 514 may also be positioned in the turned-down region 508, between the end collars 515, 516.

In another embodiment, the stop collar 514 may be positioned in the turned-down region 508 prior to the centralizer 512. For example, the centralizer 512 may initially be partially formed, e.g., rolled, but without a connected seam, prior to assembly, and then its ends welded or otherwise connected together around the stop collar 514 when located in the turned-down region 508.

Figure 6:
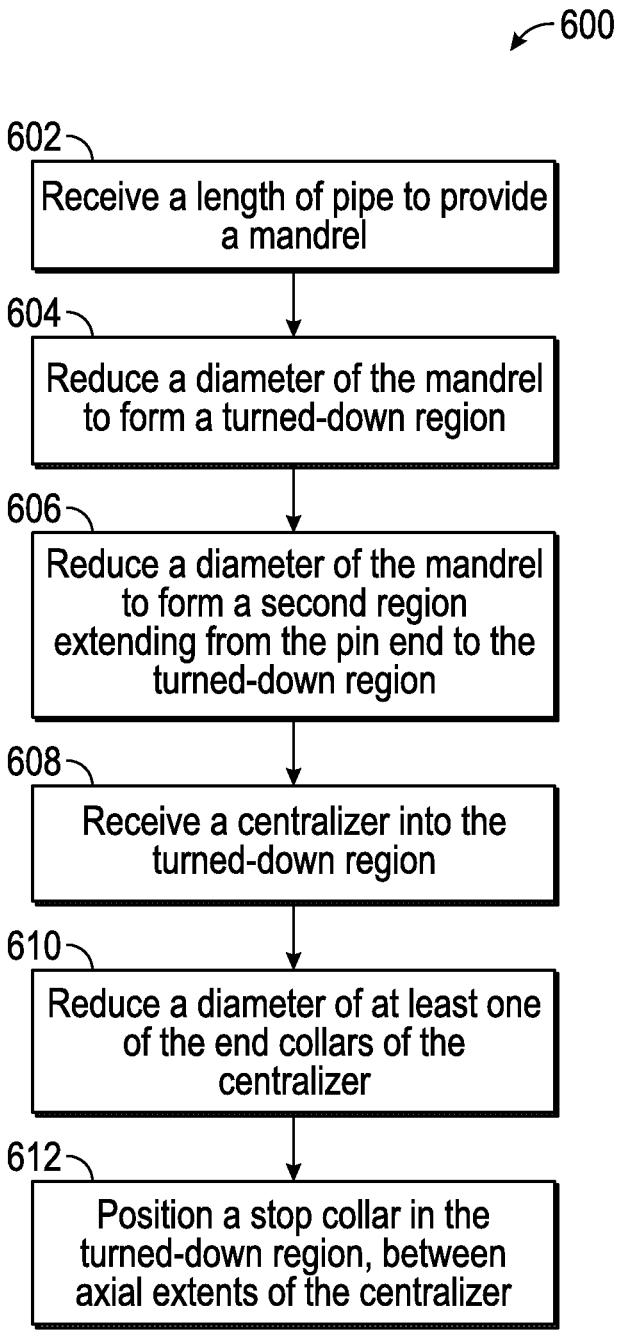
FIG. 6 illustrates a flowchart of another method for manufacturing a centralizer assembly, according to an embodiment.

FIG. 6 illustrates a flowchart of another method 600 for manufacturing a centralizer assembly, according to an embodiment. Completion of the method 600 may result in an embodiment of the centralizer assembly 500; however, in other embodiments, the method 600 may result in other centralizer assemblies, and thus is not be limited to any particular structure, unless otherwise specifically stated herein.

The method 600 may begin by receiving a length of stock pipe, such as oilfield casing, as at 602. The pipe may provide a mandrel. In other embodiments, the mandrel may be formed from other types of tubulars. The turned-down region may then be formed by reducing the diameter of the mandrel, as at 604. The turned-down region may, for example, be formed using a lathe or another cutting tool, which may cut into the surface of the stock pipe. Either or both of the cutting tool and the pipe may rotate to effect the cutting.

In another embodiment, the turned-down region may be formed by swaging the mandrel. For example, a forming mandrel may be received into the mandrel. The forming mandrel may have an outer diameter that is equal to or greater than a minimum inner diameter requirement for the mandrel. Accordingly, as the mandrel is swaged, or otherwise reduced in diameter, the forming mandrel may prevent the mandrel from collapsing radially inward, beyond design constraints. The combination of the forming mandrel and a swaging process may also increase a concentricity of the inner and outer diameters of the mandrel, at least at the turned down region.

Before, during, or after forming the turned-down region at 604, the method 600 may include reducing the diameter of the mandrel to form the second "raised" region, as at 606. The first raised region may be at least a portion of the remainder of the mandrel, away from the turned-down region and the second raised region. The second raised region may be formed by cutting into the outer diameter of the mandrel, or by swaging, etc. Forming the second raised region may also include using the forming mandrel, e.g., to control radial constriction of the inner diameter of the mandrel.

The method 600 may also include receiving a centralizer at least partially into the turned-down region, as at 608. In an example, the centralizer may be slid over the pin end and axially along the second raised region until one or both of the end collars of the centralizer are disposed in the turned-down region. Further, one or both of the end collars may be engageable with a shoulder formed where the first raised region transitions to the turned-down region and/or with a shoulder formed where the second raised region transitions to the turned-down region. In another embodiment, the centralizer may be wrapped around the mandrel at the turned-down region and then welded along a seam, so as to remain in position.

The method 600 may optionally include reducing a diameter of one or both of the end collars of the centralizer, as at 610. Such reduction may include swaging or removing an expansion force applied to the end collars. For example, the end collar may be reduced in diameter from a first size to a second size. The first size may be larger than the outer diameter of the mandrel at the second raised region. The second size may be smaller than the outer diameter of the mandrel at the second raised region. This may serve to retain the centralizer in the turned-down region. In other embodiments, however, the method 600 may not reduce the diameter of either end collar. In other embodiments, e.g., at least some embodiments where the centralizer is partially formed, and the completed when received in the turned-down region, the diameter of the centralizer may not be reduced.

The method 600 may also include positioning a stop segment or "stop collar" in the turned-down region, axially intermediate of the end collars. In some embodiments, the stop collar may be positioned prior to receiving the centralizer into the turned-down region, and thus one of the end collars may be slid over and past the stop collar. In other embodiments, the centralizer may be positioned in the turned-down region prior to the stop collar. In still other embodiments, one of the end collars may be detached from the centralizer and installed, followed by the stop collar, and then the remainder of the centralizer may be positioned in the turned-down region and attached to the end collar.

Figure 7:
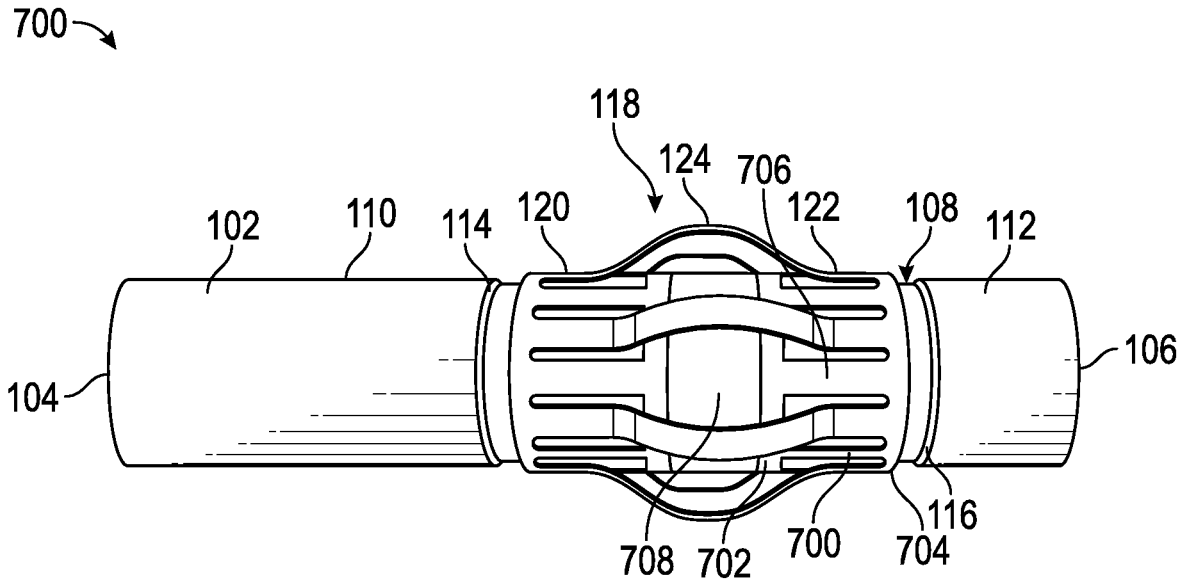
FIG. 7 illustrates a side, perspective view of another centralizer assembly, according to an embodiment.

FIG. 7 illustrates a side, perspective view of another centralizer assembly 700, according to an embodiment. The centralizer assembly 700 may be of similar construction and operation as the centralizer assembly 100, and similar components are labeled with the same reference numbers. Accordingly, the centralizer assembly 700 may include the mandrel 102, with the turned-down region 108 positioned between two raised regions 110, 112. The centralizer 118 may be positioned in the turned-down region 108, such that it is entrained between the two raised regions via shoulders 114, 116, where the turned-down region 108 transitions to the raised regions 110, 112, which may have an outer diameter that is larger than the inner diameter of the end collars 120, 122, respectively, so as to prevent axial sliding of the centralizer 118.

The end collars 120, 122 may each be provided by two bands 702, 704, which may be annular and spaced axially apart. Tabs 706 may extend between and connect the two bands 702, 704 together. In some embodiments, optionally, an intermediate stop segment 708 may be provided. The inboard bands 702 may engage the intermediate stop segment 708, which may thereby further limit axial movement of the centralizer 118, e.g., by transmitting an axial force thereto, and/or may serve to pull a centralizer 118 downward, through a restriction, rather than push the centralizer 118. The intermediate stop segment 708 may be integral with the mandrel 102, attached thereto, or formed thereon.

Figure 8:
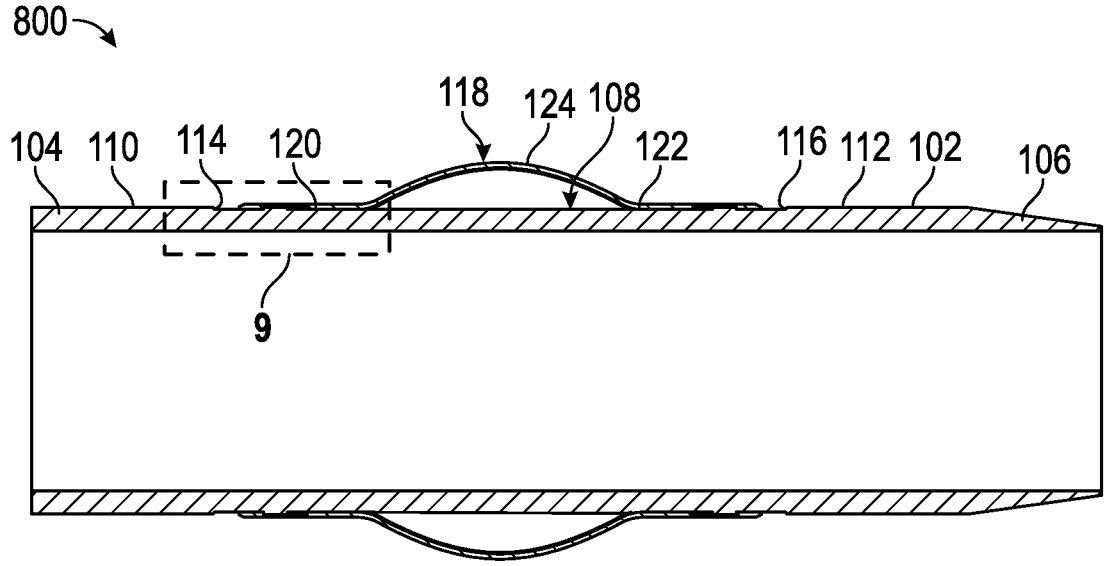
FIG. 8 illustrates a side, cross-sectional view of another centralizer assembly, according to an embodiment.
Figure 9:
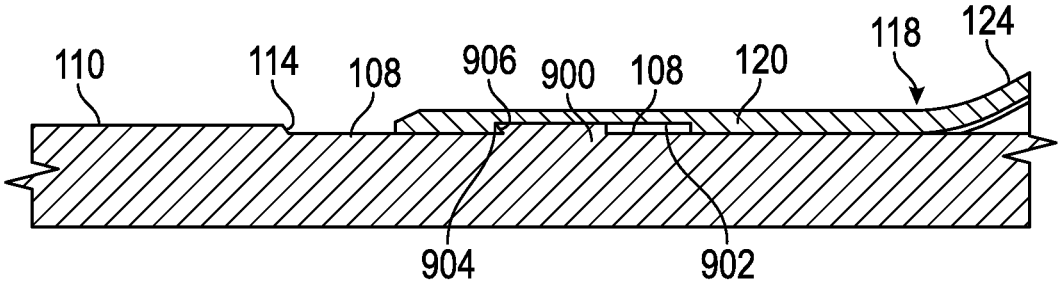
FIG. 9 illustrates an enlarged view of a portion of the centralizer assembly, as indicated in FIG. 8, according to an embodiment.

FIG. 8 illustrates a side, cross-sectional view of another centralizer assembly 800, according to an embodiment. FIG. 9 illustrates an enlarged view of a portion of the centralizer assembly 800, as indicated in FIG. 8, according to an embodiment. Referring to FIGS. 8 and 9, the centralizer assembly 800 may be similar in construction and operation to the centralizer assembly 100, and similar components are labeled with the same reference numbers.

The mandrel 102 may include the turned-down region 108. As are visible in FIG. 9, the mandrel 102 may also include a stop segment 900. The stop segment 900 may be integral with the mandrel 102 or may be a separate component that is attached thereto or formed thereon. The end collar 120 may be positioned over the stop segment 900, and may include a groove 902 into which the stop segment 900 may be received. It will be appreciated that a similar raised portion and groove may be provided for the end collar 122.

The stop segment 900 may be smaller in axial dimension than the groove 902, which may allow for an axial range of motion for the end collar 120. This may allow for the radial contraction, by axial expansion, of the centralizer 118. Further, the end collar 120 may bear on the stop segment 900 in an axial direction when brought into contact with a wellbore restriction. As such, here again, the end collar 120, and thus the centralizer 118, may be at least partially pulled through the restriction, rather than (or in addition to) being pushed therethrough.

The stop segment 900 may also include a shoulder 904. The shoulder 904 may be undercut, i.e., extend at an acute angle relative to axial. In other embodiments, the shoulder 904 may extend at 90 degrees relative to axial, so as to form a flat shoulder 904. In the illustrated, undercut embodiment of the shoulder 904, the groove 902 may include a tapered shoulder 906, which may be sized to fit at least partially into the undercut shoulder 904. This interlocking of the shoulders 904, 906 may prevent radial displacement of the mandrel 102 and the end collar 120. In some embodiments, the shoulder 906 may be undercut and the shoulder 904 may be tapered, to similar effect as the illustrated embodiment.

Figure 10:
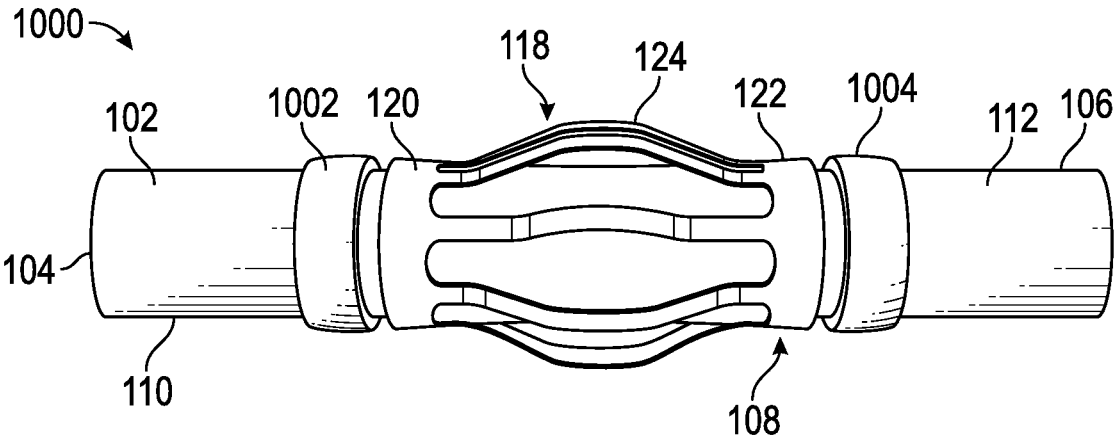
FIG. 10 illustrates a side, perspective view of another centralizer assembly, according to an embodiment.

FIG. 10 illustrates a side, perspective view of another centralizer assembly 1000, according to an embodiment. The centralizer assembly 1000 may be similar in construction and operation to the centralizer assembly 100, and similar components are labeled with the same reference numbers.

The centralizer assembly 1000 may include one or more stop devices (two shown: 1002, 1004), which may be positioned in or adjacent to the turned-down region 108. The stop devices 1002, 1004 may be formed from a thermal spray material, such as WEARSOX®, which is commercially available from Antelope Oil Tool & Mfg. Co., LLC. In other embodiments, the stop devices 1002, 1004 may be provided by other structures and/or materials, such as preformed metal collars that are attached to the mandrel 102.

The stop devices 1002, 1004 may provide the functionality provided by the shoulders 114, 116 in some of the other embodiments, serving to limit axial translation and/or stretching of the centralizer 118 in the turned-down region 108. In some embodiments, the stop devices 1002, 1004 may be formed in alignment with the shoulders 114, 116, so as to increase a radial dimension of the shoulders 114, 116. In one embodiment, the stop devices 1002, 1004 may be formed as part of the mandrel 102 (similar to shoulders 114, 116 shown in FIG. 7) rather than a separate component attached to the mandrel 102.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for manufacturing a centralizer assembly, comprising:

forming a turned-down region in a mandrel, wherein the turned-down region is axially-adjacent to a first raised region of the mandrel;

forming a second raised region of the mandrel, wherein the turned-down region is positioned between the first and second raised regions, and wherein an outer diameter of the second raised region is less than an outer diameter of the first raised region and greater than an outer diameter of the turned-down region;

positioning a first stop segment in the turned-down region; and positioning a centralizer at least partially in the turned-down region, wherein the first stop segment is positioned intermediate of axial extents of the centralizer, such that the first stop segment at least partially limits a range of motion of the centralizer relative to the mandrel.

2. The method of claim 1, wherein the centralizer comprises an end collar defining at least one window therethrough, and wherein positioning the centralizer comprises receiving the first stop segment through the window.

3. The method of claim 1, wherein the centralizer comprises a first end collar and a second end collar, wherein the first and second end collars are axially offset, and wherein the first stop segment is disposed intermediate of the first and second end collars.

4. The method of claim 1, wherein forming the turned-down region in the mandrel comprises at least one of machining or swaging the mandrel.

5. The method of claim 1, wherein the turned-down region is axially separated from ends of the mandrel, such that the first raised region and the second raised region of the mandrel are defined adjacent to the turned-down region.

6. The method of claim 5, further comprising reducing a diameter of an end collar of the centralizer from a first size to a second size, after positioning the centralizer in the turned-down region.

7. The method of claim 6, wherein positioning the centralizer comprises sliding the centralizer across the second raised region prior to reducing the diameter of the end collar to the second size.

8. The method of claim 5, further comprising forming an inclined shoulder between the turned-down region and at least one of the first raised region or the second raised region.

9. The method of claim 1, wherein positioning the first stop segment comprises at least one of:

depositing a thermal spray material in the turned-down region; or positioning an arcuate shell having a cavity on the mandrel in the turned-down region and injecting a bonding material into the arcuate shell; or during reducing the diameter of the mandrel, avoiding reducing an area in the turned-down region, such that the stop segment is integral with the mandrel.

10. The method of claim 1, wherein the centralizer comprises an end collar, and wherein an inner diameter of the end collar is less than the outer diameters of the first and second raised regions.

11. The method of claim 1, wherein positioning the centralizer comprises sliding the centralizer across the second raised region into the turned-down region.

12. The method of claim 11, wherein an inner diameter of the centralizer is larger than the outer diameter of the second raised region and smaller than the outer diameter of the first raised region when the centralizer slides across the second raised region into the turned-down region.

13. The method of claim 12, wherein the centralizer comprises an end collar, and wherein the inner diameter of the centralizer comprises the inner diameter of the end collar.

14. The method of claim 13, further comprising reducing the inner diameter of the end collar such that the inner diameter of the end collar is less than the outer diameter of the second raised region once the centralizer is positioned in the turned-down region.

15. The method of claim 14, wherein reducing the inner diameter of the end collar comprises swaging the end collar.

16. The method of claim 14, wherein reducing the inner diameter of the end collar comprises removing a force applied to the end collar.

* * * * *